US011127260B2

(12) United States Patent
Scott

(10) Patent No.: US 11,127,260 B2
(45) Date of Patent: Sep. 21, 2021

(54) ZERO VALUE PLAYING CARD GAME

(71) Applicant: Richard Jonathan Scott, Chico, CA (US)

(72) Inventor: Richard Jonathan Scott, Chico, CA (US)

( * ) Notice: Subject to any disclaimer, the term of this patent is extended or adjusted under 35 U.S.C. 154(b) by 0 days.

(21) Appl. No.: 16/171,218

(22) Filed: Oct. 25, 2018

(65) Prior Publication Data

US 2019/0259249 A1 Aug. 22, 2019

Related U.S. Application Data

(60) Provisional application No. 62/577,617, filed on Oct. 26, 2017.

(51) Int. Cl.
*A63F 1/00* (2006.01)
*G07F 17/32* (2006.01)

(52) U.S. Cl.
CPC ..... *G07F 17/3293* (2013.01); *A63F 1/00* (2013.01); *G07F 17/326* (2013.01); *A63F 2001/003* (2013.01)

(58) Field of Classification Search
None
See application file for complete search history.

(56) References Cited

U.S. PATENT DOCUMENTS

| | | | | |
|---|---|---|---|---|
| 6,773,012 | B1 * | 8/2004 | French | A63F 3/00157 273/274 |
| 8,246,049 | B1 * | 8/2012 | Martens | A63F 1/18 273/292 |
| 8,678,392 | B1 * | 3/2014 | Alhazza | A63F 1/02 273/292 |
| 2005/0093229 | A1 * | 5/2005 | Dewayne | A63F 3/00157 273/146 |
| 2009/0184472 | A1 * | 7/2009 | Cox | A63F 1/00 273/292 |
| 2018/0207525 | A1 * | 7/2018 | Amar | A63F 1/00 |

* cited by examiner

*Primary Examiner* — Damon J Pierce
(74) *Attorney, Agent, or Firm* — Buchalter; Cecily Anne O'Regan

(57) ABSTRACT

Methods and apparatuses for including zero-value playing cards in various playing card games are disclosed. Wagering techniques, playing strategies, and other game play may be changed based on the inclusion of zero-value cards in various card games.

8 Claims, 2 Drawing Sheets

| | |
|---|---|
| **Royal Flush:** A hand that consists of an ace, king, queen, jack and 10 of the same suit. | 100 |
| **Straight Flush:** A hand that consists of five cards of the same suit in consecutive ranking. A king, queen, jack, 10 and 9 is the highest ranked straight flush and a 5, 4, 3, 2 and ace is the lowest ranked straight flush. | 102 |
| **Four of a Kind:** A hand that includes four cards of the same rank. Four aces are the highest ranked four of a kind and four 2's is the lowest ranked four of a kind. | 104 |
| **Full House:** A hand that consists of a three of a kind and a pair. Three aces and two kings is the highest ranked full house and three 2's and two 3's is the lowest ranked full house. | 106 |
| **Flush:** A hand that consists of five cards of the same suit, but not in consecutive ranking. An ace, king, queen, jack and 9 is the highest ranked flush and a 7, 5, 4, 3 and 2 is the lowest ranked flush. | 108 |
| **Straight:** A hand that consists of five cards in consecutive ranking, but not of a single suit. An ace, king, queen, jack and 10 is the highest ranked straight and a 5, 4, 3, 2 and ace is the lowest ranked straight. | 110 |
| **Three of a Kind:** A hand that consists of three cards of the same rank. Three aces are the highest ranked three of a kind and three 2's is the lowest ranked three of a kind. | 112 |
| **Two Pairs:** A hand that consists of two pairs of cards, each pair of cards being of the same rank. Two aces and two kings is the highest ranked two pairs and two 3's and two 2's is the lowest ranked two pairs. | 114 |
| **One Pair:** A hand that consists of two cards of the same rank. Two aces are the highest ranked pair and two 2's is the lowest ranked pair. | 116 |
| **High Card:** A hand that consists of five cards that do not make any of the hands listed above. An ace, king, queen, jack and 9, not of a single suit is the highest ranked high card hand and 7, 5, 4, 3 and 2, not of a single suit is the lowest ranked high card hand. | 118 |

FIG. 1

ZERO VALUE PLAYING CARD GAME

BACKGROUND

Field

Aspects of the present disclosure generally relate to games of chance, and more specifically to playing card games with a zero-value card included in a card deck.

Background

Card games, such as poker, blackjack, etc., are popular pastimes. Some playing card games are also popular in gambling parlors, casinos, etc. Many card games assign points or values to each card in a deck, (i.e., two through ten, jack, queen, king, and ace), and may also assign values or points to the suits of the cards, (i.e., clubs, diamonds, hearts, and spades). Depending on the values and rules of a particular game, the basic object of each card game is to acquire a hand that is of greater and/or lesser value of your opponents.

Most card games are played with a standard fifty-two card deck, four suits with thirteen cards each. Combinations of cards, (e.g., pairs, three of a kind, etc.), may be considered higher values than a random selection of higher valued cards, as the odds of collecting 3 of a kind are higher than collecting a king, queen, and jack of random suits. Casino games may be played against the house, (e.g., blackjack), while other games may be played against other patrons, (e.g., poker).

Many "standard" playing card decks also include one or two "joker" cards, which may be used in some card games as wild cards. For example, the joker can be substituted as any card to increase the value of a player's hand. If the joker is a common or community card, such as those cards placed face up in the "Texas Hold'Em" version of poker, each player may use the joker as a different card to match their particular hand. As can be seen, the above description shows that every card, whether designated as a specific value in a suit or a joker, has a pre-defined and/or user-defined value.

SUMMARY

In an aspect of the present disclosure, a playing card having a zero value may be included with a fifty-two card deck, or a fifty-three card deck that also includes a joker. The zero-value card may be referred to as "the devil" and/or another name as appropriate for the game being played. The zero-value card may or may not have a suit (clubs, diamonds, hearts, and/or spades), or may be selectively not-combinable with a given suit, also depending on the game being played. For example, the zero-value card may only be combinable with clubs in one game, or may not be combinable with any suit or any other cards in another game.

A card game apparatus in accordance with an aspect of the present disclosure comprises a fifty-two card deck, comprising four suits, in which each suit of the four suits comprises thirteen cards, each of the thirteen cards having a designated value, and at least one zero-value card, in which the at least one zero-value card lacks the ability to combine with the designated value of any one of the fifty-two cards.

Such an apparatus further optionally includes the zero-value card also being a zero-suit card, in which the zero-suit card lacks the ability to combine with any suit of the four suits Such an apparatus further optionally includes the card game apparatus changing an odds of winning of a card game employing the card game apparatus, and employing the apparatus in games of poker and/or blackjack.

A method of playing a card game in accordance with an aspect of the present disclosure comprises adding at least a fifty-third card to a fifty-two card deck to create at least a fifty-three card deck, assigning a zero-value to the at least fifty-third card, and playing the card game with the at least fifty-three card deck.

Such a method further optionally comprises assigning a zero-suit value to the at least fifty-third card, the at least fifty-third card changing an odds of winning of a card game, and the card game being a poker and/or blackjack game.

This has outlined, rather broadly, the features and technical advantages of the present disclosure in order that the detailed description that follows may be better understood. Additional features and advantages of the disclosure will be described below. It should be appreciated by those skilled in the art that this disclosure may be readily utilized as a basis for modifying or designing other structures for carrying out the same purposes of the present disclosure. It should also be realized by those skilled in the art that such equivalent constructions do not depart from the teachings of the disclosure as set forth in the appended claims. The novel features, which are believed to be characteristic of the disclosure, both as to its organization and method of operation, together with further purposes and advantages, will be better understood from the following description when considered in connection with the accompanying figures. It is to be expressly understood, however, that each of the figures is provided for the purposes of illustration and description only and is not intended as a definition of the limits of the present disclosure.

BRIEF DESCRIPTION OF THE DRAWINGS

For a more complete understanding of the present disclosure, reference is now made to the following description taken in conjunction with the accompanying drawings.

FIG. 1 illustrates a process flow in accordance with an aspect of the present disclosure.

DETAILED DESCRIPTION

Figure 2:
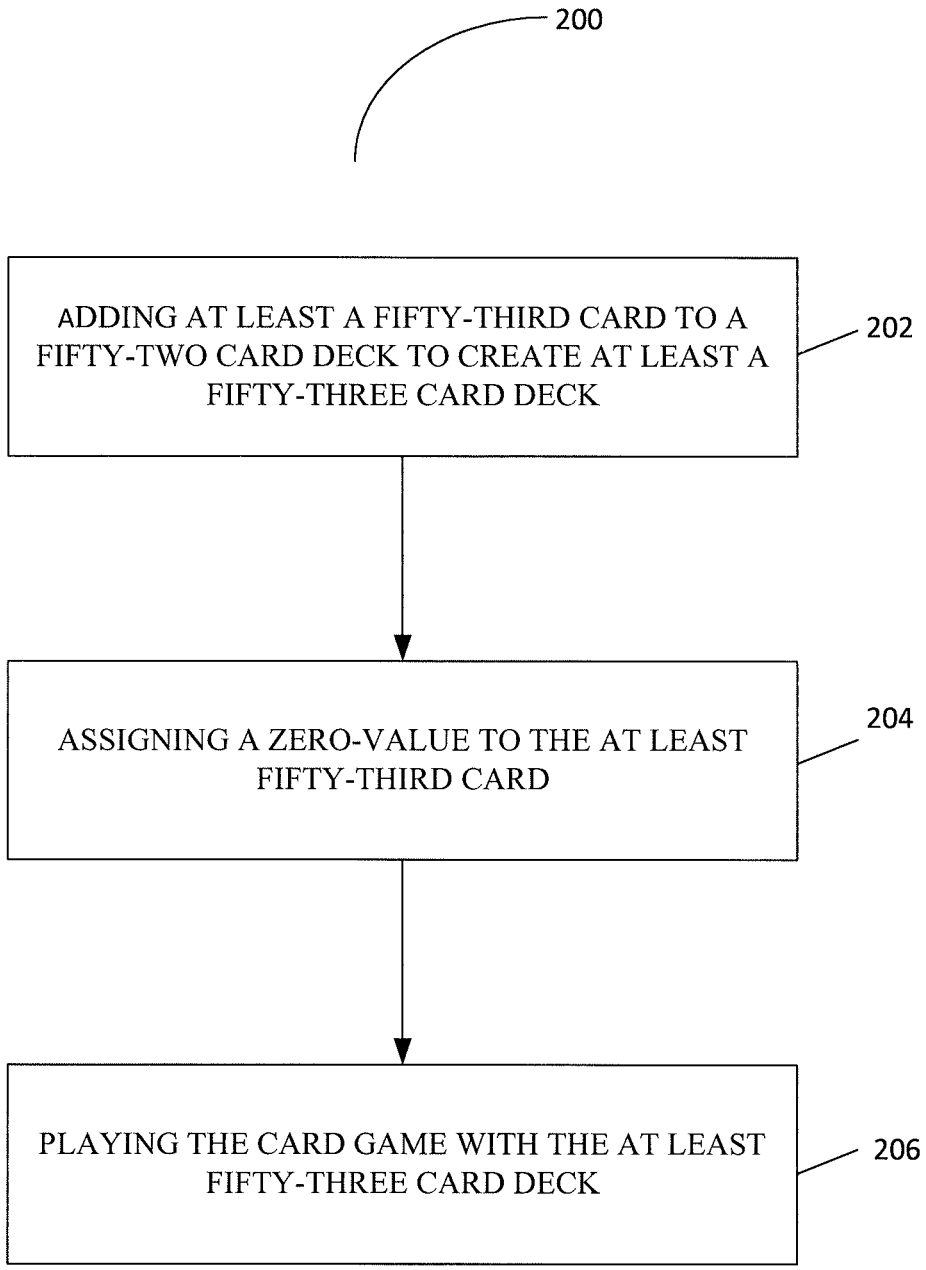
FIG. 2 illustrates a process flow in accordance with an aspect of the present disclosure.

The detailed description set forth below, in connection with the appended drawings, is intended as a description of various configurations and is not intended to represent the only configurations in which the concepts described herein may be practiced. The detailed description includes specific details for the purpose of providing a thorough understanding of the various concepts. It will be apparent to those skilled in the art, however, that these concepts may be practiced without these specific details. In some instances, well-known structures and components are shown in block diagram form in order to avoid obscuring such concepts. As described herein, the use of the term "and/or" is intended to represent an "inclusive OR", and the use of the term "or" is intended to represent an "exclusive OR".

Overview

In an aspect of the present disclosure, a playing card having a zero value may be included with a fifty-two card deck, or a fifty-three card deck that also includes a joker. The zero-value card may be referred to as "the devil" and/or another name as appropriate for the game being played. The zero-value card may or may not have a suit (clubs, diamonds, hearts, and/or spades), or may be selectively not-combinable with a given suit, also depending on the game being played. For example, the zero-value card may only be combinable with clubs in one game, or may not be combinable with any suit or any other cards in another game. Further, the zero value of a card in a fifty-two, fifty-three, and/or fifty-four card deck, or any other size deck, may be ascribed to a specific card in the deck (e.g., the three of clubs, the five of diamonds, etc.), or specific types of cards in the deck (e.g., one-eyed jacks, suicide kings, etc.).

The use of the zero-value card will be explained herein with respect to a poker-style game, also known as the "Omaha" version of Texas Hold'Em. However, a zero-value card may also be used, with and/or without a joker, in other card games without departing from the scope of the present disclosure. Further, the zero-value card may be used in games where a division ("split") of the money wagered on any given hand is employed. Such games, often referred to as "high-low split" games, allow for players to wager that they have the highest value hand and/or the lowest value hand of the players remaining in that hand.

When played in casinos, Texas Hold'Em, and in the Omaha version, a player is not often also the dealer of the cards. The casino acts as dealer and card table "boss" by maintaining the order of play and dealing cards as appropriate to the various players remaining in the hand. The casino does not participate in the wagering taking place during the play; however, the casino may take a portion of the wagered monies as compensation for providing the location for the game and the professional dealer/table boss functions.

As in most poker-style games, the object is for players to form a five-card poker hand that outranks other player's hands. In a high-low split game, some players are wagering that their hands have a higher value; others may be wagering that their hands have a lower value. In the Omaha version of Texas Hold'Em, each player is dealt four cards face down (referred to as "hole" cards), and must utilize two and only two of these four cards to form their five-card poker hand. The remaining three cards are cards are selected from five cards that are dealt face up ("community" cards or "board" cards) for all of the players to see and use in each player's respective hands. If a player wishes to make both a five-card high poker hand and a five-card low poker hand on the same deal, the player is not required to use the same hole cards and/or community cards to complete the high and low hands for comparison to the other players' hands.

Game Play

In an aspect of the present disclosure, an Omaha-style game can be played that uses one standard fifty-two card deck, plus one joker, plus one zero-value card to form a fifty-four card deck. Such a game may be referred to as an "Out Pops the Devil™" version of Texas Hold'Em. Other names may be used for versions of blackjack, hearts, spades, etc., when a zero-value card is employed in such games without departing from the scope of the present disclosure. The zero-value card may be blank on the suit/value indication side of the card, or may have a logo that differentiates the zero-value card from other cards in the deck, including differentiating the zero-value card from any joker.

FIG. 1 illustrates a ranking of five-card poker hands in accordance with an aspect of the present disclosure.

In an aspect of the present disclosure, the rank order of hands in Out Pops the Devil™ may be as shown in FIG. 1.

Block 100 illustrates a "Royal Flush" hand, which consists of an ace, king, queen, jack, and ten all from a single suit. The Royal Flush is really the highest version of the hand illustrated in block 102, the "straight flush", which is a hand consisting of five cards of the same suit in rank order.

Block 104 indicates the next highest ranked hand, known as "four of a kind," where the five-card poker hand comprises four cards of the same rank (and obviously from different suits). The fifth card of the five-card hand may be of any value, including the zero-value card if desired.

Block 106 indicates the next highest ranked hand, known as a "full house," where the five-card poker hand consists of three cards of one rank and two cards of another rank. Such a hand may be announced as "[three of a kind] full of [pair]", e.g., when a player has three aces and two kings, such a hand may be referred to as "aces full of kings."

Block 108 indicates the next highest ranked hand, known as a "flush," where the five-card poker hand consists of five cards of the same suit not in consecutive rank. Block 110 indicates the next highest ranked hand, known as a "straight," where the five-card poker hand consists of five cards of consecutive rank but not of a single suit.

Block 112 indicates the next highest ranked hand, known as "three of a kind," where the five-card poker hand comprises three cards of one rank. Two other cards are used to complete the five-card hand, although their values and/or suits are not often used to determine the value of the hand.

Block 114 indicates the next highest ranked hand, known as "two pairs," where the five-card poker hand comprises two cards of the same rank and two other cards of another rank. Such a hand may be announced as "[higher pair] over [lower pair]", e.g., when a player has two aces and two kings, such a hand may be referred to as "aces over kings." One other card is used to complete the five-card hand, although the fifth card value and/or suit is not often used to determine the value of the hand. If two players have the exact same two pairs (e.g., both players have two aces and two kings), the rank of the fifth card may be used as a tie-breaker if desired. Such a tie-breaking card may be referred to as a "kicker" to boost or "kick" one player above another in that situation.

Block 116 indicates the next highest ranked hand, known as "one pair," where the five-card poker hand comprises two cards of the same rank. Three other cards are used to complete the five-card hand, although the third, fourth, and fifth card values and/or suits are not often used to determine the value of the hand. If two players have the exact same pair (e.g., both players have two aces and two kings), the rank of the third, fourth, and/or fifth cards may be used as kickers to break a tie.

Block 118 indicates the next highest ranked hand, known as "high card," where the five-card poker hand consists of the five highest cards in a player's hand, but no pairs, three of a kinds, straights, or flushes may be made from those five cards.

In Omaha, one player is designated as being required to bet a certain amount, known as the "big blind," because the player must make this bet to place money in the pot for that hand. Another player is required to make another, smaller bet, known as the "little blind," which is often half of the big blind amount. Again, this is to provide something for the table to wager for.

Each player is then dealt four cards face down. To continue on in the deal, each player is asked in turn to match the big blind (known as a "call") or fold their hand. A player may wish to increase the amount of their wager by wagering more than the big blind (known as a "raise"), at which point subsequent players must match the largest wager being made on that betting round. Once everyone has matched the highest wager (or a certain number of raises has been reached for that round), the wagers are collected and placed in "the pot" as the stakes for that deal.

A card is then dealt face down into a discard pile and three cards are placed face up on the table. These cards, known as "the flop," are community cards for each remaining player to use in making their poker hands as described in FIG. 1. Another round of betting ensues, and once players have determined whether or not to remain in the deal and/or have placed appropriate additional wagers into the pot, another card is dealt into the discard pile and a fourth card (known as the "turn") is placed face up on the table to be used as another community card for each remaining player.

Another round of betting ensues after the turn, and once players have determined whether or not to remain in the deal and/or have placed appropriate additional wagers into the pot, another card is dealt into the discard pile and a fifth card (known as the "river") is placed face up on the table to be used as another community card for each remaining player. After the river card is turned, each remaining player in the deal can see the five community cards on the table and knows the four cards in their hand.

The relative values of high-card hands in poker are determined by the odds of obtaining such a hand on any given deal. For example, with a standard fifty-two card deck, the odds of obtaining a royal flush in standard Omaha is 1 in 32,487. When a joker is introduced into the deck, making a fifty-three card deck, the odds will decrease, because the joker provides a wild card to substitute for one of the five required cards in a royal flush. In an aspect of the present invention, the zero-value card increases the odds of obtaining a royal flush (as well as any other hand) because the zero-value card does not and cannot be used in combination with any other card that a player has. In an aspect of the present disclosure, the zero-value card has no value (i.e., no point value) but also has no suit (i.e., clubs, diamonds, hearts, or spades). As such, those games that use suits to determine winning hands, e.g., a flush in poker, trump cards in bridge, etc., would be more difficult to play and/or win if a zero-value and zero-suit card were introduced into the deck.

Should the zero-value card be a community card on a given deal, the odds of obtaining a high hand in Out Pops the Devil™ dramatically increase, because now each player must use three of the four cards showing on the table. Wagering strategies that may be memorized or determined empirically for a standard fifty-two card deck are now less applicable, because of the introduction of the zero-value card. Each player may not know if the zero-value card has been dealt, or a single player may know where the zero-value card is because it was dealt to them face down. In Out Pops the Devil™, bluffing, wagering strategies, and other game nuances may provide additional excitement and intrigue to what may otherwise be a more routine exercise in probabilities and combinatory mathematics.

Additional strategies and/or wagering techniques may be added to Out Pops the Devil™ when a high-low split version is played. Players may now also attempt to make a five-card "low" hand, where the rank in order of lowest to highest is: ace, 2, 3, 4, 5, 6, 7, 8, 9, 10, jack, queen, king. All suits are usually considered as being equal in rank. The joker is a wild card, and is very useful in creating a low hand. The zero-value card has no value, and possibly no suit, which makes it more difficult to create a five card poker hand.

An additional rule may be included for high-low split games, in that to make a qualifying five-card low hand, a player must have a 9 high or lower, meaning the two hole cards used from the player's hand and the three community cards used by the player cannot contain a card with a value of 10 or higher. Additionally, when determining if a player has a qualifying five-card low hand, straights and flushes do not disqualify the player's hand if all other requirements are met. The lowest possible five-card poker hand is 5, 4, 3, 2, and ace; this is called a "Wheel". If multiple players have qualifying five-card low hands, the winning low hand is determined by comparing the highest card of each players' five-card hand, the lowest high card would be the winning hand. For example, and not by way of limitation, a hand of 7, 6, 4, 3, and ace is lower than an 8, 6, 4, 3, and 2.

To determine which player(s) win the pot, each remaining player must use two of the four hole cards initially dealt to them at the beginning of the game and three of the five community cards turned over throughout the round of play to make the highest ranking five-card poker hand. If there is no qualifying five-card low hand, or there is no player willing to make a low hand, or the game is not a high-low split, the entire pot shall be awarded to the player with the highest ranked five-card poker hand, according to the hand and card rankings shown in FIG. 1. If there are one or more qualifying five-card low hands, as described above, the pot shall be divided equally in half, with half of the pot being awarded to the player with the highest ranked five-card poker hand and the other half of the pot being awarded to the player with the lowest qualifying five-card hand. A player is eligible to win both the high hand portion of the pot as well as the low hand portion of the pot if they have the highest ranked five-card poker hand and the lowest qualifying five-card poker hand. In another aspect of the present disclosure, if more than one player has the highest-ranking hand and there is not a qualifying five-card low poker hand, the pot shall be split equally among all players with the highest ranked five-card poker hand. Other divisions of the wagered monies are possible without departing from the scope of the present disclosure.

In another aspect of the present disclosure, the zero-value card may provide an additional bonus to a player that receives the zero-value card. For example, and not by way of limitation, a player that receives the zero-value card as a hole card may receive a portion of the wagered money, e.g., the amount of the big or small blind, etc., as a consolation for not having the same odds to win as other players in that deal. Such different winning and/or mitigation wagering techniques may also change the way people play any game that includes a zero-value card in the card deck.

For example, and not by way of limitation, if a player receives a portion of the wagered monies (the pot) for having the zero-value card as a hole card, that player may remain in the wagering rounds instead of folding their hand, since at least some of the additional wagers will return to that player. Further, if the zero-value card appears on the flop as a community card, every player would likely re-evaluate the value of their hand. Having the zero-value card appear on the turn or on the river would also change the possibilities for completing a higher value hand and/or change the strategy of the other players in the deal.

As can be seen by the above description, addition of a zero-value card changes the probabilities of obtaining a given value hand, for both high and low value hands. Since one player may only have three hole cards, or all players may only have four community cards to use to make a five-card poker hand, the possibilities of obtaining a hand that would win part or all of the pot changes. Such changes in the odds and/or probabilities may change the way players wager, as well as change the way they play any card game having a zero-value card in accordance with aspects of the present disclosure.

In an aspect of the present disclosure, a zero-value card may also be used in other games, e.g., blackjack, to change the odds of such games. Further, additional odds and/or betting lines may be added to such games for receiving the zero-value card, or for being willing to wager on receiving the zero-value card once a certain hand value is reached. As an example, a player that has a hand value of 18 in blackjack would likely not accept another card because the possibilities of going over 21 are too high. However, an additional bet and/or odds may be allowed for that player to entice the player to accept an additional card. If the zero-value card is dealt to that player, the player may win additional money. Similar odds and/or wagers are made in other casino games like craps, where when the point is "eight" wagers may be made on the board that the shooter will not only make eight but make "eight the hard way," e.g., a roll of four on each of two die. Since the probabilities of making eight the hard way are smaller than making a roll of eight in any combination, the payout on eight the hard way is higher than any given roll of eight. The addition of a zero-value card similarly allows for additional wagers to be made in playing card games, which also allows for additional strategies and playing techniques.

Other uses for the zero-value and/or zero-suit card are envisioned as being within the scope of the present disclosure. For example, in blackjack, if the house receives the zero card on the deal, there may be a penalty, or a bonus, for each of the players playing against the house. If the house receives the zero-value card, whether before or after the cards are dealt to each player, there may also be additional opportunities to bet, either for or against the house to win a given hand. Other possibilities are also envisioned as being within the scope of the present disclosure.

FIG. 2 illustrates a process flow in accordance with an aspect of the present disclosure.

Process 200 comprises an example of a process flow for an aspect of the present disclosure. Other processes are envisioned as being within the scope of the present disclosure Step 202 includes adding at least a fifty-third card to a fifty-two card deck to create at least a fifty-three card deck. Step 204 includes assigning a zero-value to the at least fifty-third card. Step 206 includes playing the card game with the at least fifty-three card deck.

As can be seen, more than one zero-value card may be added to a standard fifty-two card deck, and, if desired, both a zero-value and zero-suit card may be added as any one or more of the added cards to the standard deck. Further, a zero-value and/or zero-suit card may be used with a standard forty-eight card pinochle deck without departing from the scope of the present disclosure.

Although the present disclosure and its advantages have been described in detail, it should be understood that various changes, substitutions and alterations can be made herein without departing from the technology of the disclosure as defined by the appended claims. For example, relational terms, such as "above" and "below" may be used with respect to a device. Of course, if the device is inverted, above becomes below, and vice versa. Additionally, if oriented sideways, above and below may refer to sides of a device. Moreover, the scope of the present application is not intended to be limited to the particular configurations of the process, machine, manufacture, composition of matter, means, methods and steps described in the specification. As one of ordinary skill in the art will readily appreciate from the disclosure, processes, machines, manufacture, compositions of matter, means, methods, or steps, presently existing or later to be developed that perform substantially the same function or achieve substantially the same result as the corresponding configurations described herein may be utilized according to the present disclosure. Accordingly, the appended claims are intended to include within their scope such processes, machines, manufacture, compositions of matter, means, methods, or steps.

The description of the disclosure is provided to enable any person reasonably skilled in the art to make or use the disclosure. Various modifications to the disclosure will be readily apparent to those reasonably skilled in the art, and the generic principles defined herein may be applied to other variations without departing from the spirit or scope of the disclosure. Thus, the disclosure is not intended to be limited to the examples and designs described herein, but is to be accorded the widest scope consistent with the principles and novel features disclosed herein.

Although several embodiments have been described in detail for purposes of illustration, various modifications may be made without departing from the scope and spirit of the present disclosure. Accordingly, the disclosure is not to be limited by the examples presented herein, but is envisioned as encompassing the scope described in the appended claims and the full range of equivalents of the appended claims.

What is claimed is:

1. A method of playing a card game between a dealer and at least one player comprising:

providing a card game apparatus including a physical deck of fifty-three playing cards comprising fifty-two standard playing cards further comprising four different suits, the four different suits comprising hearts, diamonds, spades and clubs and further wherein each of the four different suits comprises thirteen cards numbered 2 through 10, Jack, Queen, King and Ace, and a fifty-third card wherein each of the thirteen cards in each of the four suits has a positive assigned numerical value and further wherein the cards numbered 2 through 10 have a value of 2 through 10 respectively, further wherein the Jack, Queen and King cards have a value of 10, and the Ace cards have a value of 1 or 11, and further wherein the fifty-third card is a zero card wherein the zero card has no value;

shuffling the playing cards into a new order;

providing the at least one player an initial card in a face-up position as a first card in a player hand;

providing the dealer an initial card in a face-down position in a dealer hand;

providing to the at least one player a second card in a face-up position;

providing the dealer a second card in a face-up position;

determining a value of the at least one player hand by adding up the value assigned to the cards in the player hand;

wherein if the at least one player has an Ace, the at least one player decides if the Ace has a value of 1 or 11;

wherein if the value of the at least one player hand is greater than 21, then the at least one player hand is bust and the dealer hand wins;

wherein if the value of the at least one player hand is less than 21, the at least one player can request an additional card or hold;

wherein if the dealer hand has the zero card, the value of the dealer hand is value of the remaining cards in the dealer hand;

wherein if the at least one player hand has the zero card, the value of the at least one player hand is value of the remaining cards in the player hand;

wherein if the at least one player hand has a hand value of 18, if the at least one player receives an additional card, the possibility of a player hand exceeding 21 is lower if the zero card remains in the deck;

further wherein if the at least one player hand has a hand value of 18, if the at least one player receives an additional card, the possibility of a player hand exceeding 21 is greater if the zero card does not remain in the deck;

wherein if the at least one player holds, one or more additional cards is provided to the dealer.

2. The method of playing a card game of claim 1 further comprising:

providing a fifty-fourth card wherein the fifty-fourth card is a second zero card and the second zero card has no value.

3. The method of playing a card game of claim 1 further comprising:

providing to the at least one player a third card in a face-up position;

determining a value of the at least one player hand by adding up the value assigned to the cards in the at least one player hand;

wherein if the at least one player hand has the zero card, the value of the at least one player hand is value of the remaining cards in the at least one player hand;

wherein if the at least one player hand has a hand value of 18, if the at least one player receives an additional card, the possibility of a player hand exceeding 21 is lower if the zero card remains in the deck; and further wherein if the at least one player hand has a hand value of 18, if the at least one player receives an additional card, the possibility of a player hand exceeding 21 is greater if the zero card does not remain in the deck.

4. The method of playing a card game of claim 3 further comprising:

providing to the at least one player a fourth card in a face-up position;

determining a value of the at least one player hand by adding up the value assigned to the cards in the at least one player hand;

wherein if the at least one player hand has the zero card, the value of the at least one player hand is value of the remaining cards in the at least one player hand;

wherein if the at least one player hand has a hand value of 18, if the at least one player receives an additional card, the possibility of a player hand exceeding 21 is lower if the zero card remains in the deck; and further wherein if the at least one player hand has a hand value of 18, if the at least one player receives an additional card, the possibility of a player hand exceeding 21 is greater if the zero card does not remain in the deck.

5. A method of playing a card game between a dealer and at least one player comprising:

providing a card game apparatus including a physical deck of fifty-three playing cards comprising fifty-two standard playing cards further comprising four different suits, the four different suits comprising hearts, diamonds, spades and clubs and further wherein each of the four different suits comprises thirteen cards numbered 2 through 10, Jack, Queen, King and Ace, and a fifty-third card wherein each of the thirteen cards in each of the four suits has a positive assigned numerical value and further wherein the cards numbered 2 through 10 have a value of 2 through 10 respectively, further wherein the Jack, Queen and King cards have a value of 10, and the Ace cards have a value of 1 or 11, and further wherein the fifty-third card is a zero card wherein the zero card has no value;

shuffling the playing cards into a new order;

providing the at least one player an initial card in a face-up position as a first card in a player hand;

providing the dealer an initial card in a face-up position in a dealer hand;

providing to the at least one player a second card in a face-up position;

providing the dealer a second card in a face-up position;

determining a value of the at least one player hand by adding up the value assigned to the cards in the player hand;

wherein if the at least one player has an Ace, the at least one player decides if the Ace has a value of 1 or 11;

wherein if the value of the at least one player hand is greater than 21, then the at least one player hand is bust and the dealer hand wins;

wherein if the value of the at least one player hand is less than 21, the at least one player can request an additional card or hold;

wherein if the dealer hand has the zero card, the value of the dealer hand is value of the remaining cards in the dealer hand;

wherein if the at least one player hand has the zero card, the value of the at least one player hand is value of the remaining cards in the player hand;

wherein if the at least one player hand has a hand value of 18, if the at least one player receives an additional card, the possibility of a player hand exceeding 21 is lower if the zero card remains in the deck;

further wherein if the at least one player hand has a hand value of 18, if the at least one player receives an additional card, the possibility of a player hand exceeding 21 is greater if the zero card does not remain in the deck;

wherein if the at least one player holds, one or more additional cards is provided to the dealer.

6. The method of playing a card game of claim 5 further comprising:

providing a fifty-fourth card wherein the fifty-fourth card is a second zero card and the zero card has no value.

7. The method of playing a card game of claim 5 further comprising:

providing to the at least one player a third card in a face-up position;

determining a value of the at least one player hand by adding up the value assigned to the cards in the at least one player hand;

wherein if the at least one player hand has the zero card, the value of the at least one player hand is value of the remaining cards in the at least one player hand;

wherein if the at least one player hand has a hand value of 18, if the at least one player receives an additional card, the possibility of a player hand exceeding 21 is lower if the zero card remains in the deck; and further wherein if the at least one player hand has a hand value of 18, if the at least one player receives an additional card, the possibility of a player hand exceeding 21 is greater if the zero card does not remain in the deck.

8. The method of playing a card game of claim 7 further comprising:

providing to the at least one player a fourth card in a face-up position;

determining a value of the at least one player hand by adding up the value assigned to the cards in the at least one player hand;

wherein if the at least one player hand has the zero card, the value of the at least one player hand is value of the remaining cards in the at least one player hand;

wherein if the at least one player hand has a hand value of 18, if the at least one player receives an additional card, the possibility of a player hand exceeding 21 is lower if the zero card remains in the deck; and further wherein if the at least one player hand has a hand value of 18, if the at least one player receives an additional card, the possibility of a player hand exceeding 21 is greater if the zero card does not remain in the deck.

* * * * *